United States Patent [19]

Lendl

[11] 4,347,005

[45] Aug. 31, 1982

[54] MECHANISM TO FACILITATE TYPE DISC CHANGES

[75] Inventor: Josef Lendl, Ottensoos, Fed. Rep. of Germany

[73] Assignee: Triumph-Adler A.G., Nuremberg, Fed. Rep. of Germany

[21] Appl. No.: 193,310

[22] Filed: Oct. 2, 1980

[30] Foreign Application Priority Data

Mar. 22, 1980 [DE] Fed. Rep. of Germany ..... 3011116

[51] Int. Cl.[3] ..... B41J 1/24

[52] U.S. Cl. ..... 400/144.2; 400/144.3; 400/175

[58] Field of Search ..... 400/144.2, 144.3, 175

[56] References Cited

U.S. PATENT DOCUMENTS 4,202,639 5/1980 Rello ..... 400/144.2 X 4,289,412 9/1981 Dollenmayer ..... 400/144.3 X

OTHER PUBLICATIONS

*Xerox Disclosure Journal,* vol. 4, No. 2, Mar./Apr. 1979, pp. 175–176, "Print Wheel Removal Assist Means,".

*Primary Examiner*—Edgar S. Burr

*Assistant Examiner*—Daniel J. Roock

*Attorney, Agent, or Firm*—Joseph R. Spalla

[57] ABSTRACT

A device to facilitate the changing of disc-shaped type carriers in typewriters or printers includes a lever operated device to push against the type disc and to press it off its shaft. A basket is provided to catch the type wheel after its disengagement from the shaft to prevent it from falling into the interior of the machine.

4 Claims, 6 Drawing Figures

MECHANISM TO FACILITATE TYPE DISC CHANGES

This invention relates to type disc typewriters or like machines; more particularly, it relates to means for disengaging type discs from a drive shaft for removal.

Type disc typewriters are especially suited for typing in different character styles by changing the type disc. However, changing of the type disc is not generally easy and convenient, because spatial conditions prevent access to the axis of the type disc. In some machines, notwithstanding the type disc and its drive motor are pivoted as a unit to enable manual disengagement and removal, access is impeded. U.S. Pat. No. 3,986,593 is exemplary in that considerable space is required for manually releasing the connection between the type disc and its shaft.

DE-OS No. 28 22 313 shows another expedient wherein a type disc is arranged in a cassette for insertion as a unit in the machine to automatically establish engagement of the type disc to its shaft. This expedient, however, is complicated and expensive.

In accordance with the invention a machine assembly is provided characterized by a pivotally mounted lever acting when pivoted to effect disengagement of a type disc from its shaft for easy removal without first having to pivot out the type disc and its drive motor.

An object of the invention is in the provision of means to make the changing of the type disc of a typewriter simple and convenient for the operator.

Another object of the invention is in the provision of type disc changing means having simple, easily manufactured and assembled parts for mounting in the machine to facilitate disengagement of the type disc from its shaft by simple pressure of a finger, whereby it can then conveniently be taken by hand out of an integrally formed catch basket.

Other objects, features and advantages of the present invention will become known to those skilled in the art from a reading of the following detailed description when taken in conjunction with the accompanying drawing wherein like reference numerals designate like or corresponding parts throughout the several views thereof, and wherein.

Figure 1:
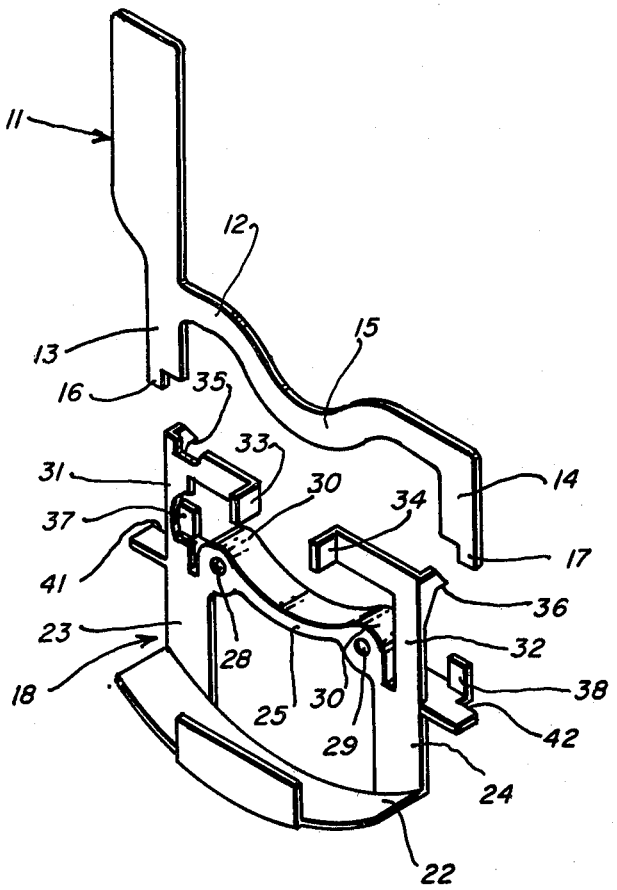
FIG. 1 is a exploded perspective view of the parts comprising the invention.

Referring now to the drawing there is shown in FIG. 1 an H-shaped actuating lever generally designated by reference numeral 11, having a horizontal web 12 and depending legs 13 and 14. In its central region 15 the web 12 is arched downward. At the ends of the legs 13 and 14, projections 16 and 17 are formed. The actuating lever 11 may be, e.g., a simple stamped part.

Figure 2:
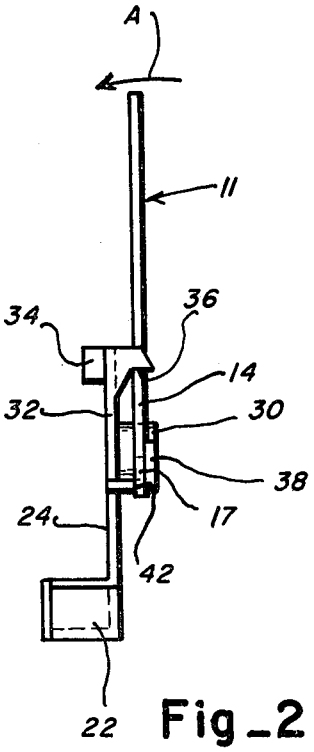
FIG. 2 is a side elevational view of the parts shown in FIG. 1 assembled.
Figure 3:
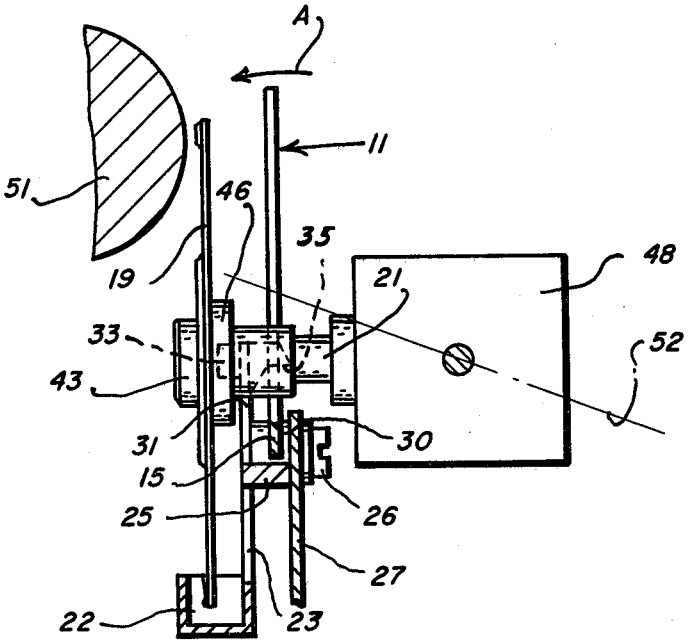
FIG. 3 is a partial sectional view of the assembled parts mounted in a machine.

With reference to FIGS. 1–3 there is shown a support means generally designated by reference numeral 18 which is adapted to be secured to the type disc supporting frame or carriage. The support means 18 also is adapted to pivotally support the actuating lever 11 and, in response to actuating lever movement, to disengage the type disc 19 from its shaft 21.

As shown most clearly in FIG. 1 the support means 18 includes an arcuate shaped catch basket 22 to catch a disengaged type disc 19. The catch basket 22 has two vertical supports 23 and 24, which are connected by a horizontal connecting web 25 also centrally arched downwardly. The catch basket 22 is attached as shown in FIG. 3 by screws 26 to a support frame 27 constituting the type disc supporting carriage by means of threaded openings 28 and 29 in bosses 30 formed on the web 25 inwardly adjacent the vertical supports 23 and 24. Extending upwardly from the vertical supports 23 and 24 are flexible ejector fingers 31, 32 whose upper ends are bent inwardly and toward the type disc 19 forming ejector lugs 33, 34. Actuating lever retainer hooks 35 and 36 are also integrally formed on the upper ends of the ejector fingers 31, 32 and extend oppositely to the direction to the ejector lugs 33, 34. Further, actuating lever retaining lugs 37, 38 are also formed on the connecting web 25 extending outwardly of the flexible fingers 31, 32 and the outermost ends of the web are provided with notches 41, 42.

As can be seen from FIG. 2, the actuating lever 11 is placed on the support means 18 from above in such a way that the projections 16 and 17 of the arms 13 and 14 insert themselves into the notches 41 and 42 in the horizontal web 25. The lever 11 is retained by lugs 37, 38 and by hooks 35 and 36 which snap over the top edges of the web 12 of the actuating lever to hold it against upward movement. The flexible ejector fingers 31, 32 are designed to press the actuating lever 11, in its inoperative or rest position, against the lugs 37, 38 on the web 25 of the support means 18. The actuating lever 11 can, however, readily be pivoted in the direction of arrow A, (FIG. 2) whereby the ejector fingers 31 and 32 flex and are taken along. The point of connection between actuating lever 11 and the support means 18 in the region of the notches 41 and 42 acts as a pivot.

Figure 4:
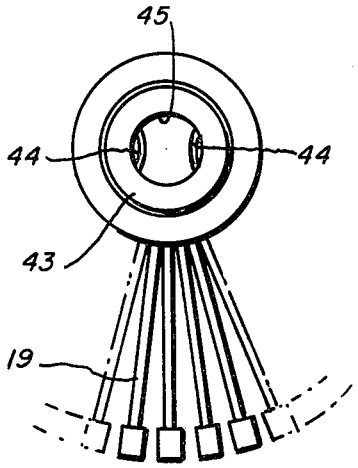
FIG. 4 is a partial front elevational view of a type disc showing the removable mounting.
Figure 5:
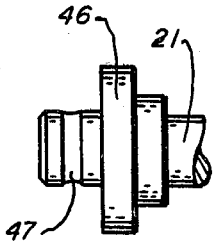
FIG. 5 is an elevational view of the end-portion of the type disc drive shaft.

As shown in FIGS. 3–5 the type wheel 19 is provided with a cap 43, carrying spring means 44 protruding into the center bore 45 thereof. These spring means may, e.g., be the arms of a stirrup spring. Shaft 21 is provided with an abutment disc 46 against which the type disc 19 bears in the mounted state. As shown in FIG. 5 the spring means 44 engages an annular groove 47 of shaft 21. The opposite end of shaft 21 is driven by the motor 48 which drives the type disc 19.

In the mounted state of the entire devices, the ejector lugs 33 and 34 of the ejector fingers 31 and 32 are spaced a certain distance from the type disc 19. However, if the actuating lever 11 is pivoted in the direction of arrow A toward the disc type 19 and a platen 51, the ejector lugs 33, 34 press against the type disc 19 and thus push the type disc 19 off the shaft 21, so that the type disc 19 drops off and is caught by the catch basket 22. The type disc 19 can then conveniently be taken out of the machine. As the actuating lever 11 is let go, the spring action of the flexible fingers 31, 32 returns it to rest position against retaining lugs 37, 38. A dash-dot line 52 indicates that motor 48 can be pivoted together with its shaft 21, the type disc 19, frame 27 of the carriage, and the support means 18. The operation of the actuating lever 11 and of the support means 18 is not changed thereby and a new type disc 9 can then be pressed onto the shaft 21 by simple pressure with a finger.

The arches in the webs 15 and 25 allow assembly without hindrance of shaft 21. As seen in FIG. 3 the ejector lugs 33, 34 are expediently located at the level of the axis of shaft 21, so as to avoid tilting of the type disc 19 when pivoting the actuating lever 11.

Figure 6:
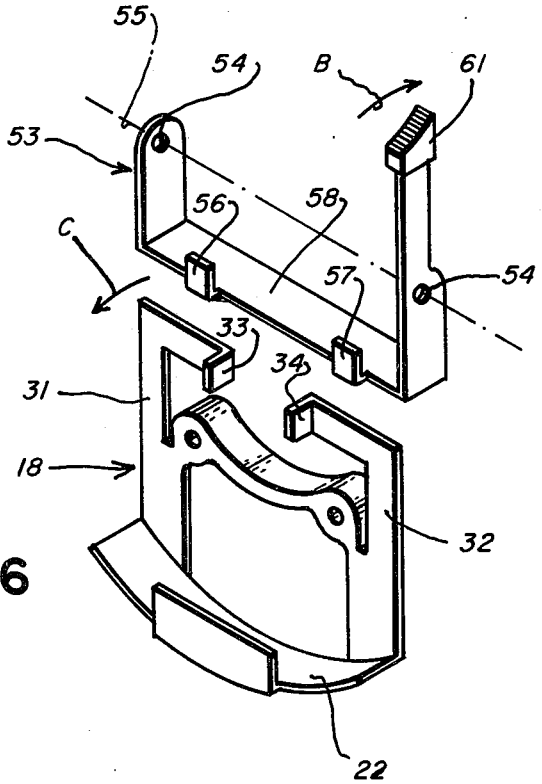
FIG. 6 is a perspective view of another embodiment of the invention.

In reference to FIG. 6 another embodiment is shown, in which the support means 18 and the ejector fingers 31 and 32 are similar to those according to FIG. 1. In this embodiment the actuating lever 53 is U-shaped and is pivotably fastened by means of the two bores 54 for movement about a horizontal axis 55 to the frame 27. Tabs 56 and 57 on the horizontal leg 58 of the lever 53 cooperate with the ejector fingers 31 and 32. As can be seen from FIG. 6, the actuating lever 53 is actuated by means of a finger piece 61 in the direction of arrow B, that is, the reverse direction to that in the embodiment according to FIGS. 1 to 3. The actuating lever 53 here pivots about the axis 55 and the tabs 56 and 57 press the ejector fingers 31 and 32 in the direction of arrow C, so that the ejector lugs 33, 34 push the type disc 19 off its shaft 21. Also in this embodiment, the ejector fingers 31, 32 act as springs and press the actuating lever 53, when it is leg go, back into a rest position. This arrangement is advantageous where, because of other structural parts, a pivoting of the actuating lever in the direction of arrow A is difficult. Also in this embodiment the support means 18 may be molded plastic and the actuating lever 53 a stamped part.

As the drawing shows, it is possible with simple means, even under restricted space conditions, to change a type wheel conveniently. Moreover, making the device from molded plastic and stamped parts results in low manufacturing costs.

The invention claimed is:

1. In a typewriter having a support frame for supporting a positioning motor and shaft having a type disc removably mounted on the end of said shaft, means for facilitating type disc changes comprising support means secured to said support frame, means for axially pushing said type disc off said shaft comprising flexible fingers extending upwardly from said support means with the upper ends thereof on opposite sides of said shaft on the motor side of said type disc and normally out of contact with said type disc, lever means, and means pivotally supporting said lever means for movement relative to said support means, said lever means being normally biased to rest position by said flexible fingers and being pivotally movable to push said flexible fingers against and to axially push off and disengage said type disc from said shaft.

2. In a typewriter as recited in claim 1, said support means including an arcuate catch basket located outwardly of the end of said shaft and below the type disc to catch a disengaged type disc for easy removal.

3. In a typewriter as recited in claim 2, said means pivotally supporting said lever means being located below the upper ends of said flexible fingers to allow type disc disengaging pivotal movement of said lever means toward said type disc, and said flexible fingers having retainer means engageable with said lever means above its said pivot.

4. In a typewriter as recited in claim 2, said means pivotally supporting said lever means for movement relative to said support means being above the upper ends of said flexible fingers to allow type disc disengaging pivotal movement of said lever means away from said type disc.

* * * * *